US006281918B1

(12) United States Patent
Burdick et al.

(10) Patent No.: US 6,281,918 B1
(45) Date of Patent: Aug. 28, 2001

(54) LASER PRINTHEAD MOUNTING APPARATUS AND PRINTHEAD SKEW ADJUSTMENT MECHANISM FOR AN ELECTROPHOTOGRAPHIC MACHINE

(75) Inventors: Robert Leonard Burdick, Lancaster; Christopher Gregory Chee, Lexington; Harald Portig, Versailles; Earl Dawson Ward, II, Richmond; Paul Douglas Horrall, Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/526,653

(22) Filed: Mar. 15, 2000

(51) Int. Cl.[7] ..... B41J 2/385; G03G 13/04
(52) U.S. Cl. ..... 347/116; 347/138; 347/263
(58) Field of Search ..... 347/116, 138, 347/263, 245, 118, 129, 130

(56) References Cited

U.S. PATENT DOCUMENTS 5,218,383 * 6/1993 Kondou et al. ..... 347/130
5,374,993 * 12/1994 Diehl et al. ..... 347/138 X
5,812,169 * 9/1998 Tai et al. .
6,055,006 * 4/2000 Murano ..... 347/118
6,201,558 * 3/2001 Bennett et al. ..... 347/138

FOREIGN PATENT DOCUMENTS 1-6917 * 1/1989 (JP) .
7-261489 * 10/1995 (JP) .

* cited by examiner

*Primary Examiner*—Susan S. Y. Lee
(74) *Attorney, Agent, or Firm*—Taylor & Aust, P.C.

(57) ABSTRACT

An apparatus for correcting printhead skew in an electrophotographic machine. The electrophotographic machine includes a machine frame having a plurality of mounting locations, at least one printhead, and a plurality of resilient elongate beam members. Each of the plurality of resilient elongate beam members have a proximal end and a distal end, wherein each proximal end is attached to the printhead and each distal end is attached to a respective one of the mounting locations of the machine frame, thereby mounting the printhead to the machine frame. The printhead further includes a printhead base having a pivot axis defined, at least in part, by a location of attachment of said plurality of resilient elongate beam members. The apparatus further includes a skew adjustment mechanism for effecting a pivot of the printhead about the pivot axis.

37 Claims, 4 Drawing Sheets

LASER PRINTHEAD MOUNTING APPARATUS AND PRINTHEAD SKEW ADJUSTMENT MECHANISM FOR AN ELECTROPHOTOGRAPHIC MACHINE

BACKGROUND OF THE INVENTION

1. Field of the Invention

The present invention relates to an electrophotographic machine, and more particularly, to a laser printhead mounting apparatus and printhead skew adjustment mechanism for an electrophotographic machine, such as a laser printer.

2. Description of the Related Art

In a typical in-line color electrophotographic imaging process, latent images are formed on a plurality of photosensitive drums, which are in turn each developed using a predetermined color of toner. Typically, these colors are black, magenta, cyan and yellow. The developed images are then transferred to either an intermediate transfer medium or directly to a sheet of media (such as paper) that travels past the photosensitive drums. The image in each color is created one line at a time, and the lines are oriented at right angles to the direction of travel of the media. The individually-generated images combine to form a full-color image. Thus, in a typical multi-color laser printer, the sheet of media receives color images generated at each of the four image developing stations.

It is recognized that in order for the multi-color laser printer to print accurately, the laser beams for all four colors must be in alignment, both in the scan direction (i.e., the direction the laser sweeps across the photoreceptive medium) and the process direction (feed direction of the print medium). However, providing proper alignment of even a single laser printhead in relation to the sheet of media in the process direction can be difficult. This problem is compounded with the addition of each printhead, since the plurality of printheads must be in registration so that the individual images generated by each printhead can be superimposed correctly when combined. During printer assembly an attempt is made to optically align the laser printheads both individually and collectively, but the ability to provide precise alignment is limited by several factors, including component manufacturing tolerances. In addition, it is possible for a precisely aligned printhead to drift out of alignment over time due to component aging and ambient environmental factors, such as temperature. Skew is one such alignment parameter which can be corrected by mechanical rotation of the printhead relative to a pivot point located in the printer mounting frame. Skew is the slope of a least squares fit straight line through all of the laser spots across a scan line.

It is known that one can use one of a variety of sliding or pivoting mechanisms to mount a printhead to a printer frame and to provide adjustment of the position of a printhead in an adjustment direction to correct printhead skew. However, such sliding mechanisms are difficult to control when attempting to make small adjustments necessitating movement of the slide mechanism over a very short distance. In attempting small adjustments, there is a likelihood that the mechanism will exhibit the phenomenon know as "stick-slip", or frictional hysteresis, which makes repeatability uncertain. For example, an executed command to move the slide mechanism a certain distance at one time may not be repeatable in producing the same amount of motion at another time. In addition, when the fasteners mounting the printhead to the mounting frame are tightened, unwanted rotation can produce an error in skew registration.

What is needed in the art is an apparatus that can consistently provide precise and repeatable printhead skew adjustment in an electrophotographic machine to compensate for printhead alignment errors due to printhead skew.

SUMMARY OF THE INVENTION

The present invention provides an apparatus that can consistently provide precise and repeatable printhead skew adjustment in an electrophotographic machine to compensate for printhead alignment errors due to printhead skew.

One aspect of the invention relates to an electrophotographic machine, including a machine frame having a plurality of mounting locations, a printhead for scanning a laser beam in a scan direction, and printhead base. A plurality of resilient elongate beam members extend from the printhead base, wherein each of the plurality of resilient elongate beam members have a distal end which includes a mounting aperture for engaging a respective one of the plurality of mounting locations of the machine frame through a suitable fastener.

In one preferred embodiment of the invention, a pivot axis of the printhead is defined, at least in part, by a location of attachment of the plurality of resilient elongate beam members to the printhead. A skew adjustment mechanism effects a pivot of the printhead about the pivot axis to effect printhead skew correction.

One advantage of the present invention is that it provides rigid mounting of a printhead to a printer frame along five of six degrees of freedom, while permitting adjustability in the sixth degree of freedom.

Another advantage of the present invention is that it provides a printhead orientation adjustment mechanism that is not adversely affected by frictional hysteresis, or by tightening mounting fasteners.

Still another advantage of the present invention is that it provides precise and repeatable printhead skew adjustment in an electrophotographic machine to compensate for printhead alignment errors due to printhead skew.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
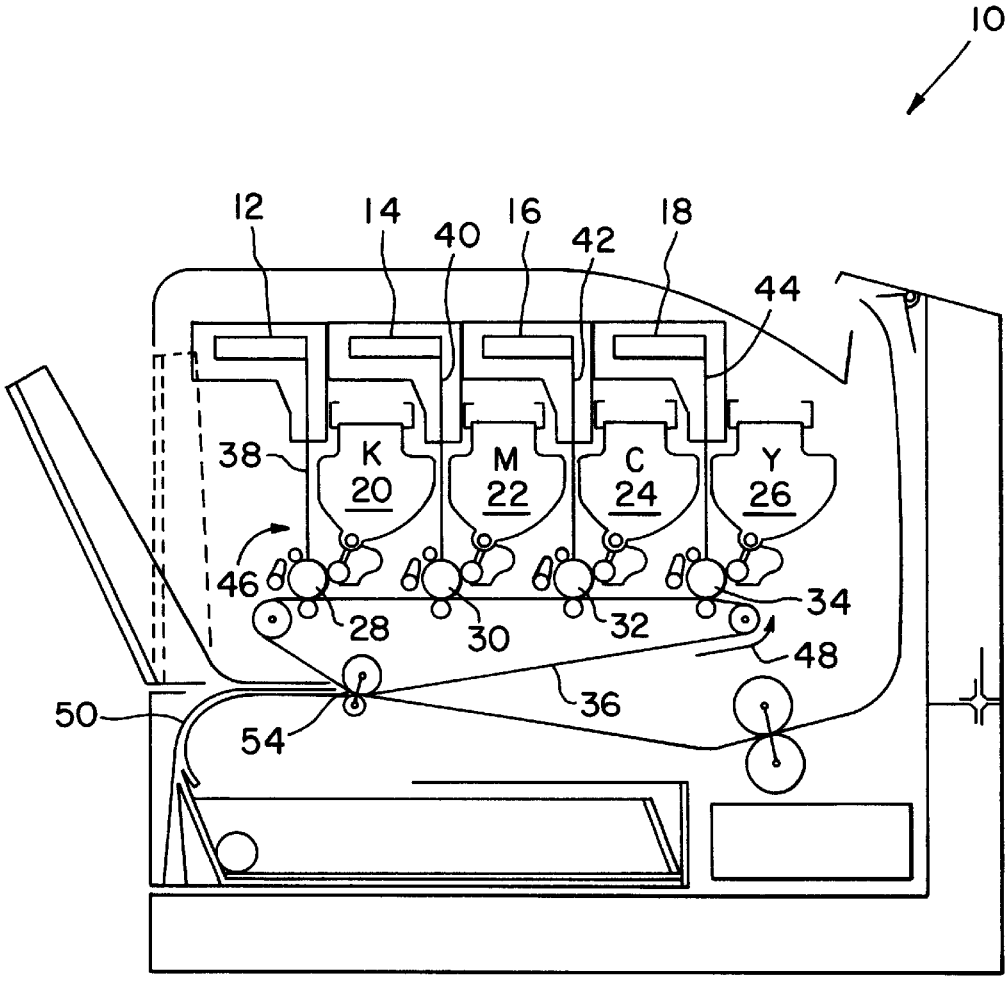
FIG. 1 is a side sectional view of a multicolor laser printer embodying the present invention.

Referring now to the drawings and, more particularly, to FIG. 1, there is shown one embodiment of a multicolor laser printer 10 including laser printheads 12, 14, 16, 18, a black toner cartridge 20, a magenta toner cartridge 22, a cyan toner cartridge 24, a yellow toner cartridge 26, photoconductive drums 28, 30, 32, 34, and an intermediate transfer member belt 36.

Each of laser printheads 12, 14, 16 and 18 scans a respective laser beam 38, 40, 42, 44 in a scan direction, perpendicular to the plane of FIG. 1, across a respective one of photoconductive drums 28, 30, 32 and 34. Each of photoconductive drums 28, 30, 32 and 34 is negatively charged to approximately −900 volts and is subsequently discharged to a level of approximately −200 volts in the areas of its peripheral surface that are impinged by a respective one of laser beams 38, 40, 42 and 44 to form a latent image thereon made up of a plurality of dots, or pels. During each scan of a laser beam across a photoconductive drum, each of photoconductive drums 28, 30, 32 and 34 is continuously rotated, clockwise in the embodiment shown, in a process direction indicated by direction arrow 46. The scanning of laser beams 38, 40, 42 and 44 across the peripheral surfaces of the photoconductive drums is cyclically repeated, thereby discharging the areas of the peripheral surfaces on which the laser beams impinge.

The toner in each of toner cartridges 20, 22, 24 and 26 is negatively charged to approximately −600 volts. Thus, when the toner from cartridges 20, 22, 24 and 26 is brought into contact with a respective one of photoconductive drums 28, 30, 32 and 34, the toner is attracted to and adheres to the portions of the peripheral surfaces of the drums that have been discharged to −200 volts by the laser beams. As belt 36 rotates in the direction indicated by arrow 48, the toner from each of drums 28, 30, 32 and 34 is transferred to the outside surface of belt 36. As a print medium, such as paper, travels along path 50, the toner is transferred to the surface of the print medium in nip 54. If it is determined that one or more of printheads 12, 14, 16, 18 are identified as being skewed, the printhead orientation is adjusted using the printhead skew adjustment apparatus of the invention, as is more fully described below.

Each of printheads 12, 14, 16, 18 is substantially identical in structure. Accordingly, to simplify the discussion and for ease of understanding the invention, only the structure of printhead 12 will be described in detail below in relation to FIGS. 2 and 3. However, it is to be understood that the discussion that follows with respect to printhead 12 also applies to each of printheads 14, 16, and 18.

Figure 2:
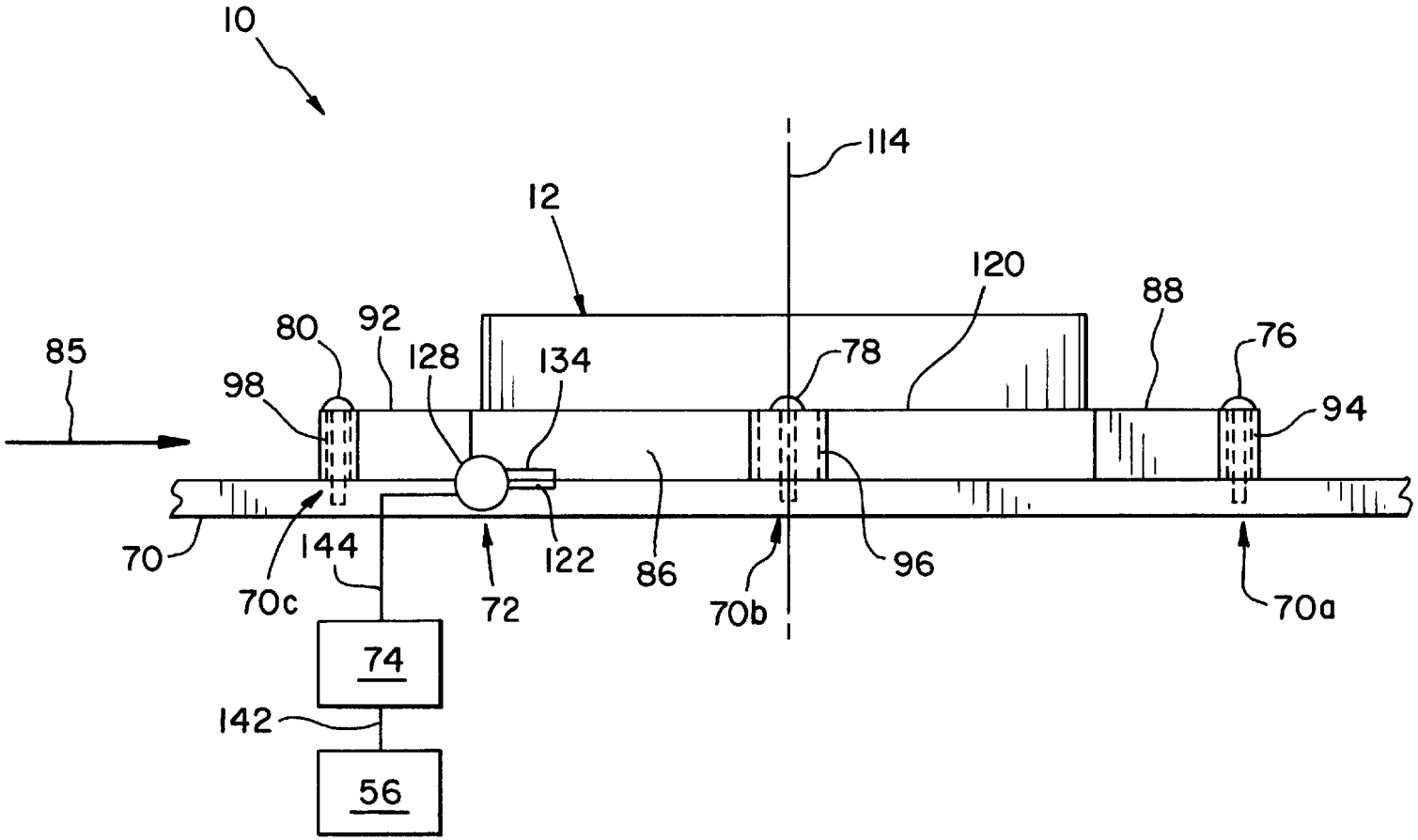
FIG. 2 is a front view of a portion of the multicolor laser printer of FIG. 1 illustrating a printhead of the invention.

FIG. 2 shows a portion of laser printer 10 including a printer frame 70, printhead 12, a printhead skew adjustment mechanism 72, a controller 74 and a sensor 56.

As shown in FIG. 2, printhead 12 is mounted to printer frame 70 at mounting locations 70*a*, 70*b* and 70*c* by a plurality of mounting fasteners 76, 78 and 80, respectively.

Printhead 12 includes a laser beam generator and associated optics, including a multi-faceted scanning mirror, and control electronics mounted to a printhead base 86 for providing scanning control of the laser beam in a direction of scanning as depicted by direction arrow 85.

Figure 3:
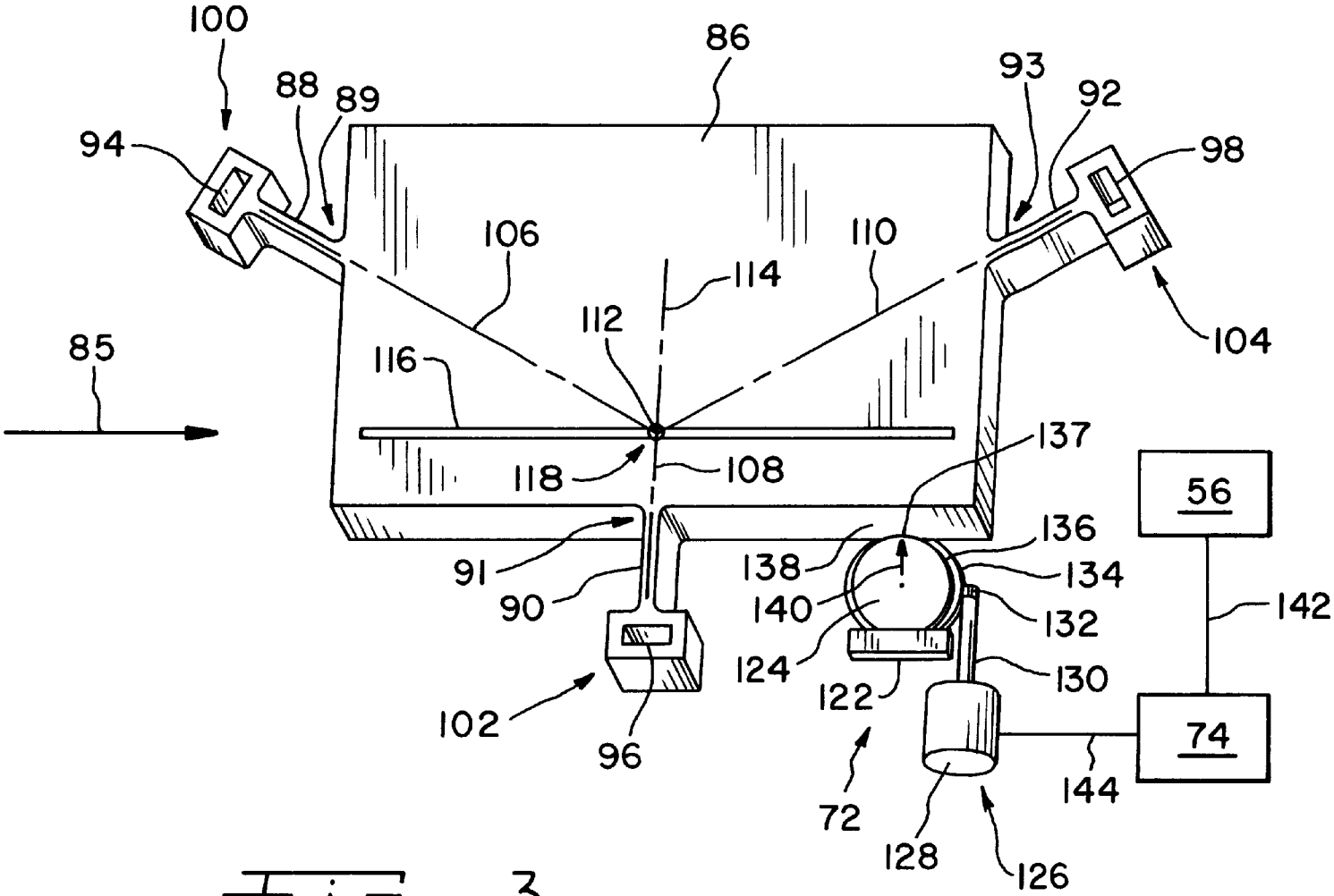
FIG. 3 is a bottom perspective view of the printhead base and adjustment mechanism of the printhead depicted in FIG. 2.

As can be seen best in the bottom perspective view of FIG. 3, a plurality of resilient elongate beam members 88, 90, 92 are providing for mounting printhead 12 to printer frame 70. Elongate beam members 88, 90, 92 include proximal ends 89, 91, and 93, respectively, and extend outwardly toward corresponding distal ends 100, 102, 104, respectively. Thus, printhead base 86 is fixedly attached to elongate beam members 88, 90, 92 at proximal ends 89, 91, and 93 thereof. Each of elongate beam members 88, 90, 92 includes a mounting slot 94, 96, 98, respectively, located near distal end 100, 102, 104, respectively, for receiving a respective one of mounting fasteners 76, 78, 80 to fixedly, e.g., rigidly, mount distal ends 100, 102, 104 to printer frame 70, as shown in FIG. 2.

As shown, preferably, elongate beam members 88, 90, 92 are formed integral with printhead base 86. Alternatively, however, elongate beam members 88, 90, 92 may be independent components and configured for separate attachment to each of printhead 12 and printer frame 70, or as a further alternative, formed integral with printer frame 70 and configured for separate attachment to printhead 12.

Referring again to FIG. 3, an orientation of elongate beam members 88, 90, 92 in relation to base 86 is defined by a corresponding plurality of centerlines 106, 108, 110, respectively. Each of centerlines 106, 108, 110 is co-extensive with a respective one of elongate beam members 88, 90, 92. In the embodiment of FIG. 3, a point of intersection 112 of centerlines 106, 108, 110 defines a general location of a pivot axis 114 of printhead base 86. Pivot axis 114 is perpendicular to a plane 120, as shown in FIG. 2.

As shown, elongate beam members 88, 90, 92 have a rectangular cross-section and are designed to be flexible only in the direction normal to their respective thin dimension. Thus, when attached to printer frame 70, elongate beam members 88, 90, 92 provide rigid mounting of printhead 12 to printer frame 70 along five of six degrees of freedom, i.e., along the degrees of freedom other than around pivot axis 114. With respect to the sixth degree of freedom around pivot axis 114, elongate beam members 88, 90, 92 are resilient, and provide pivotal mounting of printhead 12 to printer frame 70 around pivot axis 114. Pivot axis 114 may be shifted, however, depending upon the location of printhead skew adjustment mechanism 72 in relation to printhead base 86.

Printhead base 86 includes a scan slot 116 arranged along scan direction 85 for passing the laser beam generated by printhead 12. Also, scan slot 116 has a central portion 118, preferred to be at the center of the scan line of the laser beam, through which pivot axis 114 passes. As can be best seen in FIG. 2, pivot axis 114 is substantially perpendicular to a plane 120 of base 86 and printhead 12. By appropriate location of elongate beam members 88, 90, 92, pivot axis 114 may be moved to other desired locations.

Referring to FIGS. 2 and 3, but particularly FIG. 3, printhead skew adjustment mechanism 72 acts on base 86 to effect a pivot of printhead base 86 about pivot axis 114 to provide precise and repeatable skew correction of printhead 12. To some extent, the location of placement of printhead skew adjustment mechanism 72 with respect to printhead 12 will affect the location of pivot axis 114. Printhead skew adjustment mechanism 72 includes a cam backstop 122, a cam 124, and a drive unit 126.

Preferably, drive unit 126 is mounted (either fixedly or removably) to printer frame 70, although alternatively drive unit 126 could be mounted to printhead base 86 of printhead 12. Drive unit 126 includes a motor 128, such as a stepper motor, having a rotatable shaft 130, a worm gear 132 attached to shaft 130, and a driven gear 134 which engages worm gear 132. Preferably, the gear reduction exhibited by gear train 132, 134 is about 144:1. Those skilled in the art will recognize that, alternatively, other types of drive units having alternative gear, friction wheel, or pulley configurations could be used.

Cam backstop 122 is mounted to printer frame 70. Cam 124 is floatably attached to and rotates in conjunction with driven gear 134, and is thereby rotatably mounted to printer frame 70, in the preferred case. By the term "floatably attached", it is meant that cam 124 does not have a fixed axis of rotation corresponding to that of driven gear 134. Cam 124 has a cam surface 136 that engages cam backstop 122 and engages at a contact point 137 a cam follower surface 138 of base 86 of printhead 12. Preferably, the cam profile defined by the shape of cam surface 136 is a continuous non-circular profile having two symmetrical lobes with respective points of peak lift, or displacement, located 180 degrees apart. While many cam profile shapes are possible, it is preferred that cam surface 136 be involute so that the separation between base 86 of printhead 12 and cam backstop 122 is linearly related to the angle of rotation of cam 124. Alternatively, and less preferably, a cam having a fixed axis of rotation and having a single lobe could be used, and the cam backstop could be eliminated.

The mechanical advantage of cam 124 is selected to be high (i.e., the rise of cam surface 136 is low), for example, such that a rotation of cam 124 by 150 degrees produces a change of 0.3 millimeters in the distance between backstop 122 and cam follower surface 138. Since cam backstop 122 is mounted to printer frame 70, this change of 0.3 millimeters translates into a pivot of base 86 about pivot axis 114, which in turn modifies the orientation of scan slot 116 and printhead 12, with respect to printer frame 70. Thus, cam surface 136 slides against both cam backstop 122 and cam follower surface 138 of base 86 through a distance significantly larger than the distance traveled by printhead 12, as measured from point of contact 137 in the direction indicated by arrow 140, as a result of the pivoting of base 86 around pivot axis 114. The ratio of the two relative movements will be about 100:1. The benefit of this high mechanical advantage is that very small and repeatable movements of printhead 12 can be obtained without being influenced by frictional hysteresis.

The force in the sixth degree of freedom around pivot axis 114 required to maintain printhead 12 stable in the direction indicated by arrow 140 during normal printing operation is provided by cam 124. Although resilient, elongate beam members 88, 90, 92 are designed to be sufficiently rigid to apply a force in the direction opposite to the direction of arrow 140 to hold cam follower surface 138 in contact with cam surface 136, and in turn, hold cam surface 136 in contact with cam backstop 122. In the event that the deflection of elongate beam members 88, 90, 92 does not produce adequate cam contact force, additional force can be obtained by supplementing the flexure force exerted by elongate beam members 88, 90, 92 with a spring (not shown) to insure cam surface 136 maintains contact with surfaces 138 and 122.

Controller 74 is electrically connected to sensor 56 via an electrical conductor 142. Also, controller 74 is connected to motor 128 of drive unit 126 via an electrical conductor 144. Controller 74 includes a microprocessor and an associated memory for storing program instructions directed to correlating the movement of cam 124 into a printhead skew correction amount.

Figure 4:
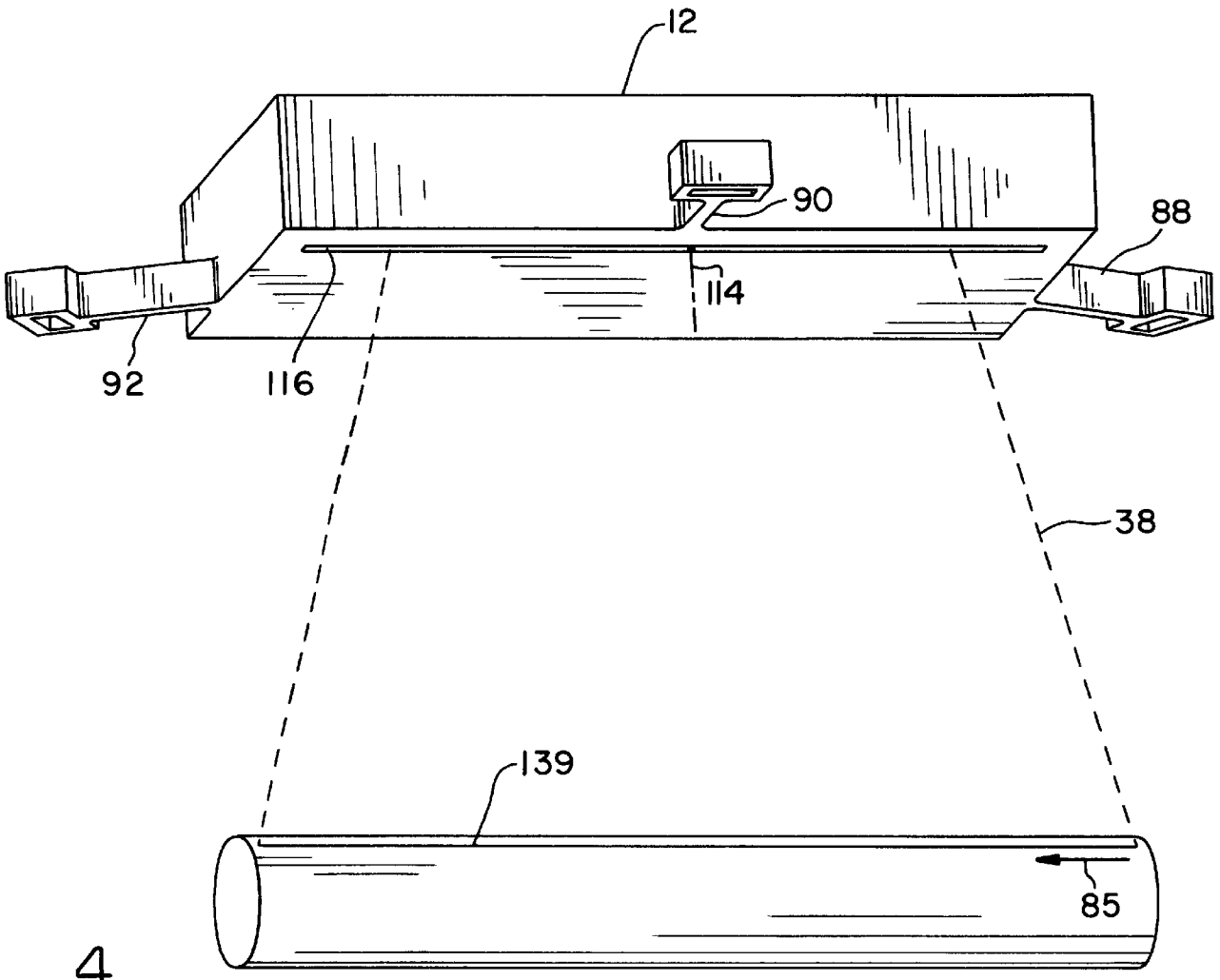
FIG. 4 is a perspective view of the printhead showing the laser scan line on a photoconductive drum.

In operation, sensor 56 generates a skew signal that is related to a skew position of printhead 12. Sensor 56 supplies the skew signal to controller 74 via electrical conductor 142. Based upon the skew correction signal, the cam profile of cam 124, and the gear ratio of gear train 132, 134, controller 74 generates an adjustment signal that is sent to drive unit 126 via electrical conductor 144 to control the rotation of shaft 130 of motor 128. In turn, drive unit 126 rotates cam 124 via gear train 132, 134, and in turn, the rotation of cam 124 effects the pivoting of printhead base 86 about pivot axis 114, which in turn rotates the orientation of a scan 139 (FIG. 4) of laser beam 38 of printhead 12, about pivot axis 114. Thus, cam 124 is rotated an amount sufficient to correct for the amount of skew of printhead 12 detected by sensor 56. In a preferred embodiment, assuming a gear reduction ratio of 144:1 and a cam profile providing relative movements of the cam surface in relation to cam surface rise (times two) of 100:1, two revolutions of shaft 130 will result in a movement of printhead 86 a distance of 0.1 millimeters along an arc intersecting point of contact 137 and having at its center pivot axis 114.

While the present invention provides automatic adjustment of the orientation of a printhead, such as printhead 12, to correct for undesirable printhead skew, those skilled in the art will recognize that signals could be generated external to printer 10 which mimic the skew signals provided by sensor 56 and used to manually adjust the printhead orientation. In addition, it is contemplated that the adjustment cam, such as cam 124, could be driven by a manually actuated adjustment device. Still further, it is contemplated that printhead skew correction mechanism 72 could be replaced by a conventional manual or gear driven screw-type adjustment mechanism.

The present invention has been described herein as being used in conjunction with a laser printer. However, it is to be understood that it is possible for the present invention to be adapted for use in conjunction with other types of electrophotographic imaging apparatus, such as copying machines.

While this invention has been described as having a preferred design, the present invention can be further modified within the spirit and scope of this disclosure. This application is therefore intended to cover any variations, uses, or adaptions of the invention using its general principles. Further, this application is intended to cover such departures from the present disclosure as come within known or customary practice in the art to which this invention pertains and which falls within the limits of the appended claims.

What is claimed is:

1. An electrophotographic machine, comprising:

a machine frame having a plurality of mounting locations;

a printhead for generating a laser beam; and a plurality of resilient elongate beam members, each of said plurality of resilient elongate beam members having a proximal end and a distal end, wherein each said proximal end is attached to said printhead and each said distal end is attached to a respective one of said mounting locations of said machine frame, thereby mounting said printhead to said machine frame, said resilient elongate beam members rigidly mounting said printhead to said frame along a plurality of degrees of freedom and flexing along at least one degree of freedom.

2. An electrophotographic machine, comprising:

a machine frame having a plurality of mounting locations;

a printhead for generating a laser beam, said printhead further includes a printhead base having a pivot axis; and a plurality of resilient elongate beam members, each of said plurality of resilient elongate beam members having a proximal end and a distal end, wherein each said proximal end is attached to said printhead and each said distal end is attached to a respective one of said mounting locations of said machine frame, thereby mounting said printhead to said machine frame, said plurality of resilient elongate beam members having a location of attachment defining, at least in part, said pivot axis.

3. The electrophotographic machine of claim 2, wherein said printhead base includes a slot arranged along a scan direction for passing said laser beam, and wherein said pivot axis passes through said slot.

4. The electrophotographic machine of claim 2, further comprising a skew adjustment mechanism for effecting a pivot of said printhead base about said pivot axis.

5. The electrophotographic machine of claim 4, wherein said skew adjustment mechanism comprises:

a cam backstop mounted to said machine frame; and a cam having a continuous cam surface which engages both said cam backstop and said printhead base.

6. The electrophotographic machine of claim 5, wherein said cam surface has a profile having two symmetrical lobes with respective points of peak lift located 180 degrees apart.

7. The electrophotographic machine of claim 5, wherein said skew adjustment mechanism further comprises a drive unit coupled to said cam to rotate said cam, wherein a rotation of said cam effects said pivot of said printhead base about said pivot axis.

8. The electrophotographic machine of claim 7, wherein said drive unit comprises:

a motor having a rotatable shaft;

a drive gear connected to said shaft; and a driven gear connected to said cam, said driven gear engaging said drive gear.

9. The electrophotographic machine of claim 4, wherein said skew adjustment mechanism comprises:

a cam; and a drive unit coupled to said cam to rotate said cam, wherein a rotation of said cam effects said pivot of said printhead base about said pivot axis.

10. The electrophotographic machine of claim 9, wherein said cam has a continuous profile having two symmetrical lobes with respective points of peak lift located 180 degrees apart.

11. The electrophotographic machine of claim 4, further comprising:

a sensor for generating a skew signal related to a skew position of said printhead; and a controller connected to said sensor for receiving said skew signal and connected to said skew adjustment mechanism, said controller responding to said skew signal by generating an adjustment signal, said controller supplying said adjustment signal to said skew adjustment mechanism to effect said pivot of said printhead base about said pivot axis.

12. An apparatus for correcting printhead skew in an electrophotographic machine, said electrophotographic machine including a machine frame having a plurality of mounting locations and a corresponding plurality of mounting fasteners, and a printhead for scanning a laser beam in a scan direction, said apparatus comprising:

a printhead base having a plurality of outwardly extending resilient elongate beam members, each of said plurality of resilient elongate beam members having a distal end which includes a mounting aperture for engaging a respective one of said plurality of mounting fasteners to fixedly attach said distal ends to said mounting locations of said machine frame, wherein an orientation of said plurality of elongate beam members in relation to said base is defined by a corresponding plurality of centerlines, each of said plurality of centerlines being co-extensive with a respective one of said plurality of beam members, wherein a point of intersection of said plurality of centerlines substantially defines a pivot axis of said printhead base; and a skew adjustment mechanism for effecting a pivot of said printhead base about said pivot axis.

13. The apparatus of claim 12, wherein said skew adjustment mechanism comprises:

a cam backstop mounted to said machine frame; and a cam rotatably mounted to said machine frame, said cam having a continuous cam surface which engages said cam backstop and said printhead base.

14. The apparatus of claim 13, wherein said cam surface defines a cam profile having two symmetrical lobes with respective points of peak lift located 180 degrees apart.

15. The apparatus of claim 13, wherein said skew adjustment mechanism further comprises a drive unit configured to be removably mountable to said machine frame, said drive unit engaging said cam to rotate said cam, wherein a rotation of said cam effects said pivot of said printhead base about said pivot axis.

16. The apparatus of claim 15, further comprising:

a sensor for generating a skew signal related to a skew position of said printhead; and a controller connected to said sensor for receiving said skew signal and connected to said skew adjustment mechanism, said controller responding to said skew signal by generating an adjustment signal, said controller supplying said adjustment signal to said drive unit.

17. The apparatus of claim 12, wherein said skew adjustment mechanism comprises:

a cam; and a drive unit coupled to said cam to rotate said cam, wherein a rotation of said cam effects said pivot of said printhead base about said pivot axis.

18. An electrophotographic machine, comprising:

a machine frame having a plurality of mounting locations;

a plurality of mounting fasteners for attachably engaging said plurality of mounting locations;

a printhead for scanning a laser beam in a scan direction, said printhead including a printhead base and a plurality of resilient elongate beam members, said plurality of resilient elongate beam members extending away from a central portion of said printhead base, each of said plurality of resilient elongate beam members having a distal end which includes a mounting aperture for receiving a respective one of said plurality of mounting fasteners for fixed attachment of said distal ends to said plurality of mounting locations of said machine frame.

19. The electrophotographic machine of claim 18, further comprising a skew adjustment mechanism for effecting a pivot of said printhead about a pivot axis.

20. The electrophotographic machine of claim 19, wherein said skew adjustment mechanism comprises a cam having an involute cam profile.

21. The electrophotographic machine of claim 18, wherein said plurality of resilient elongate beam members are coupled to said printhead via a base having a cam follower surface.

22. The electrophotographic machine of claim 21, wherein said skew adjustment mechanism comprises:

a cam backstop mounted to said machine frame; and a cam having a continuous cam surface which engages said cam backstop and said cam follower surface of said base.

23. The electrophotographic machine of claim 22, further comprising a drive unit coupled to said cam to rotate said cam, wherein a rotation of said cam effects said pivot of said base about a pivot axis.

24. An apparatus for mounting a printhead to an electrophotographic machine including a machine frame having a plurality of mounting locations and a plurality of mounting fasteners for attachably engaging said plurality of mounting locations, said apparatus comprising a printhead base having a plurality of resilient elongate beam members extending from a central portion of said printhead base, each of said plurality of resilient elongate beam members having a distal end which includes a mounting aperture for receiving a respective one of said plurality of mounting fasteners.

25. The apparatus of claim 24, wherein an orientation of said plurality of elongate beam members in relation to said printhead base is defined by a corresponding plurality of centerlines, each of said plurality of centerlines being co-extensive with a respective one of said plurality of beam members, wherein a point of intersection of said plurality of centerlines substantially defines a pivot axis of said printhead base.

26. An electrophotographic machine, comprising:

a machine frame having a plurality of mounting locations;

a printhead for scanning a laser beam in a scan direction, said printhead including a printhead base; and a plurality of resilient elongate beam members attached to said printhead base, each of said plurality of resilient elongate beam members having a distal end which includes a mounting structure configured for attachment to a respective one of a plurality of mounting locations to thereby fixedly attach said printhead base to said machine frame, said resilient elongate beam members rigidly mounting said printhead along at least one degree of freedom and flexing along at least one degree of freedom.

27. An electrophotographic machine, comprising:

a machine frame having a plurality of mounting locations;

a printhead for scanning a laser beam in a scan direction, said printhead including a printhead base;

a plurality of resilient elongate beam members attached to said printhead base, each of said plurality of resilient elongate beam members having a distal end which includes a mounting structure configured for attachment to a respective one of a plurality of mounting locations to thereby fixedly attach said printhead base to said machine frame; and a corresponding plurality of centerlines defining an orientation of said plurality of elongate beam members in relation to said printhead base, each of said plurality of centerlines being co-extensive with a respective one of said plurality of beam members, wherein a point of intersection of said plurality of centerlines defines a location of a pivot axis of said printhead base.

28. An electrophotographic machine of claim 27, wherein said printhead base includes a slot arranged along said scan direction for passing said laser beam, and wherein said pivot axis passes through said slot.

29. The electrophotographic machine of claim 27, further comprising a skew adjustment mechanism for effecting a pivot of said printhead base about said pivot axis.

30. The electrophotographic machine of claim 29, wherein said skew adjustment mechanism comprises:

a cam backstop mounted to said machine frame; and a cam having a continuous cam surface which engages both said cam backstop and said base of said printhead base.

31. A machine, comprising:

a frame having a plurality of mounting locations;

a printhead; and a plurality of resilient elongate beam members, each of said plurality of resilient elongate beam members having a proximal end and a distal end, wherein each said proximal end is attached to said printhead and each said distal end is attached to a respective one of said mounting locations of said frame, thereby mounting said printhead to said frame, said resilient elongate beam members providing rigid mounting of said printhead along at least one degree of freedom and flexing along at least one degree of freedom.

32. The machine of claim 31, wherein said printhead and said plurality of resilient elongate beam members are formed as an integral unit.

33. A machine, comprising:

a frame having a plurality of mounting locations;

a printhead;

a plurality of resilient elongate beam members, each of said plurality of resilient elongate beam members having a proximal end and a distal end, wherein each said proximal end is attached to said printhead and each said distal end is attached to a respective one of said mounting locations of said frame, thereby mounting said printhead to said frame, said plurality of resilient elongate beam members including a location of attachment defining, at least in part, a pivot axis of said printhead.

34. The machine of claim 33, further comprising a mechanism for pivoting said printhead about said pivot axis.

35. The machine of claim 34, wherein said mechanism comprises:

a cam backstop mounted to said frame; and a cam rotatably mounted to said frame, said cam having a continuous cam surface which engages said cam backstop and a cam follower surface of said printhead.

36. The machine of claim 35, wherein said cam has a continuous profile having two symmetrical lobes with respective points of peak lift located 180 degrees apart.

37. The machine of claim 35, further comprising:

a sensor for generating a skew signal related to a skew position of said printhead;

a drive unit configured to be removably mountable to said frame, said drive unit engaging said cam to rotate said cam, wherein a rotation of said cam effects said pivot of said printhead about a pivot axis; and a controller connected to said sensor for receiving said skew signal and connected to said drive unit, said controller responding to said skew signal by generating an adjustment signal, said controller supplying said adjustment signal to said drive unit.

* * * * *